United States Patent [19]

Richter

[11] Patent Number: 4,986,029

[45] Date of Patent: Jan. 22, 1991

[54] WINDOW REGULATOR FOR VEHICLE DOORS

[75] Inventor: Herbert A. Richter, Walled Lake, Mich.

[73] Assignee: Wickes Manufacturing Company, Southfield, Mich.

[21] Appl. No.: 495,486

[22] Filed: Mar. 19, 1990

[51] Int. Cl.[5] ..... E05F 11/44

[52] U.S. Cl. ..... 49/349; 49/351

[58] Field of Search ..... 49/348, 349, 358, 351, 49/352, 353, 227, 374, 375

[56] References Cited

U.S. PATENT DOCUMENTS

| | | | |
|---|---|---|---|
| 2,236,448 | 3/1941 | Roethel | 49/350 X |
| 3,783,702 | 1/1974 | Dehler | 74/89 |
| 4,414,779 | 11/1983 | Ishii | 49/349 X |

*Primary Examiner*—Philip C. Kannan

*Attorney, Agent, or Firm*—David A. Greenlee

[57] ABSTRACT

A powered cross-arm window regulator assembly for a vehicle door having a unitized spacer and isolator of an engineering plastic material interposed between the motor and the sector gear and the support bracket of the assembly. This spacer and isolator dissipate some vibrational energy of the drive assembly and provides a cushioned and quiet downstop for the sector gear. The isolator presents a low friction bearing which contacts one side of the sector gear and cooperates with a low friction bearing on the bracket to provide a supporting guide for the sector gear therebetween during its pivotal operation in raising and lowering the window allowing the gear to be made with a large centralized cutout so that its mass is reduced. Furthermore, the isolator has locating pins to assist in the assembly of the regulator assembly insuring that it is properly put together for optimized operational efficiency.

8 Claims, 2 Drawing Sheets

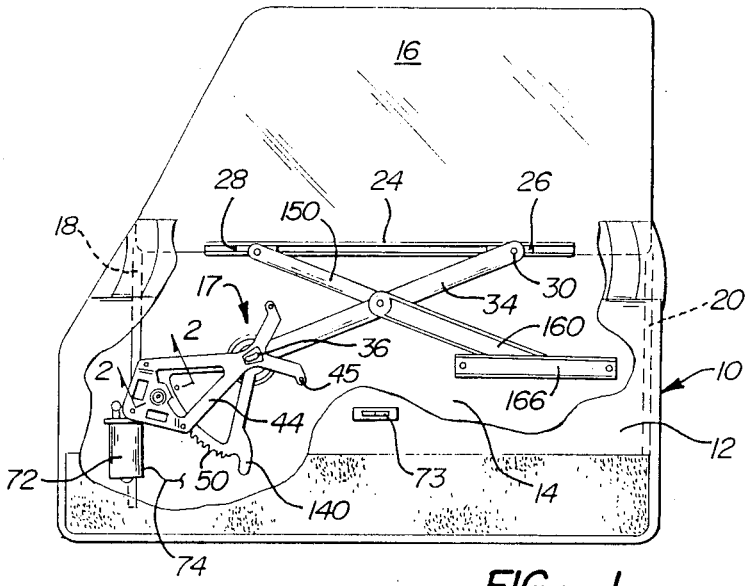
FIG - 1
FIG - 2
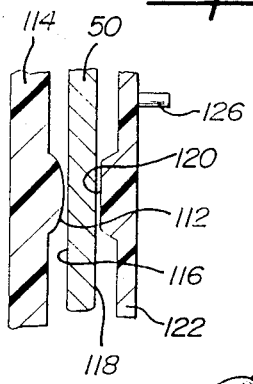
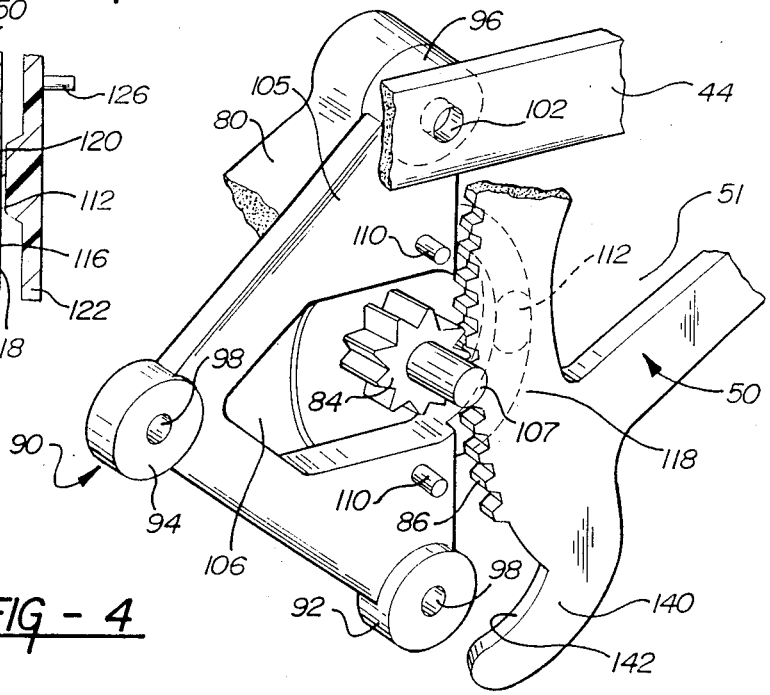
FIG - 4

WINDOW REGULATOR FOR VEHICLE DOORS

TECHNICAL FIELD

This invention relates to vehicle window regulators and more particularly to a new and improved window regulator assembly featuring a unitized motor mounting spacer and isolator construction which improves assembly of the regulator, the isolation of the motor from the mounting bracket and the sector gear, and further which provides new and improved low-friction support of the sector gear with a cushioned stop for the sector gear at one end of its travel.

BACKGROUND OF THE INVENTION

Window regulators such as those of cross-arm configuration have been developed for vehicle doors to facilitate driver or passenger control over the positioning of the window in the door of the vehicle. These regulators generally employ massive sector gears turned by energizable electric motor and transmission units that move the window panel to an infinitely variable number of positions as selected by the operator. While such window regulators have generally provided good window adjustment and control, there are ongoing requirements for reducing the weight of vehicle components such as window regulators and their motor drives and for improved regulator operation with reduced noise level and smoother operation with low noise stop at the end of the travel of the window panel. To this end, the present invention provides a new and improved regulator that features a unitized motor mount, preferably of an engineering thermoplastic material such as nylon or DELRIN that isolates the motor from the mounting brackets and the sector gear and which provides for the employment of a lighter weight sector gear and motor drive while making regulator operation smoother and noise-free with a cushioned downstop.

These and other features, objects and advantages of this invention will become more apparent from the following detailed description and drawings in which:

BRIEF DESCRIPTION OF THE DRAWINGS

FIG. 1 is a fragmentary and partially broken away elevational view of a door of an automobile having a window panel and regulator assembly according to this invention;

FIG. 2 is a sectional view taken along line 2—2 of FIG. 1 as viewed in the direction of the indicator arrows;

FIG. 4 is a pictorial view of a portion of the window regulator assembly according to this invention.

DETAILED DESCRIPTION OF THE INVENTION

Figure 3:
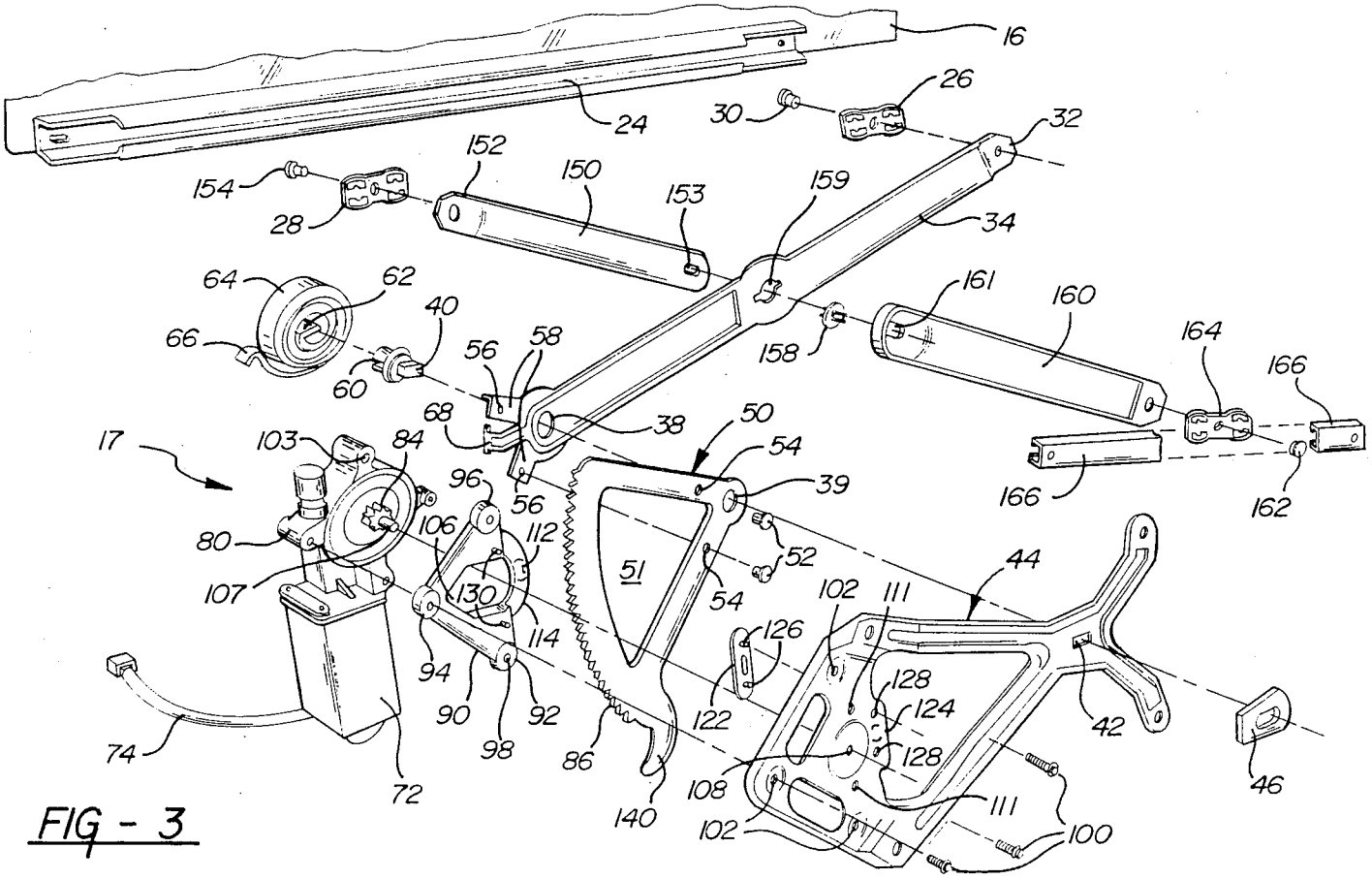
FIG. 3 is an exploded view of the components of the window regulator assembly according to this invention.

Turning now in greater detail to the drawings, there is shown in FIG. 1 a door 10 for a vehicle that is adapted to be hinged at its forward edge to a vehicle body, not shown, for swinging movement between an open and closed position. The door includes spaced inner and outer panels 12 and 14 welded together to form a conventional window storage well. The inner and outer panels converge generally at the belt line of the vehicle to form a sealing window panel slot, not shown, extending longitudinally of the vehicle body in its closed door position. A safety glass window panel 16 is sealingly received within the longitudinal slot of the door for movement by the powered operation of a regulator assembly between a raised position shown in FIG. 1 and a lowered position within the confines of forward and rear guide channels 18 and 20 that form the ends of the window well within the door.

The window panel 16 is bolted or otherwise secured to an elongated, lower sash channel 24 mounted in the well below the upper slot. The channel 24 provides a track that faces inboard that receives a pair of low friction slides 26 and 28 for the cross-arms of the regulator assembly described hereinafter. The slide 26 is secured by a pivot pin 30 to the outer end 32 of an elongated actuator arm 34 of the cross-arm regulator assembly 17. This actuator arm is mounted for limited pivotal movement on a pivot 36, shown best in FIG. 3, which projects through a circular mating opening 38 in the inner end of the actuator arm 34 and circular opening 39 in a sector gear later described. The rectilinear head 40 of this pivot extends through a mating slot 42 and a multi-armed sheet metal bracket 44 which is secured by fastener means such as threaded fastener 45 to the inner panel of the vehicle body. A retainer 46 is secured to the rectilinear head of the pivot 36 to secure the pivot to the bracket 44.

The inner end of the actuator arm 34 has a reduced weight sector gear 50 secured thereto by threaded fasteners 52. These fasteners extend through openings 54 in the arcuately spaced arms of the sector gear and through openings 56 in the radially and arcuately spaced arms 58 located at the inner end of the actuator arm 34. The sector gear is stamped or otherwise formed with the arcuately spaced arms of the sector gear to thereby define a generally triangular central opening 51 which effectively reduces the weight of the gear and window regulator assembly including the motor drive to contribute to the reduction in weight of the automobile in which such window regulators are employed.

The inner end of the pivot member 36 is slotted at 60 to receive and round a radial inner tang 62 of a coiled window counterbalance spring 64. The outer end of this spring has a hooked radial outer end 66 so that the spring is wound as the arm 34 pivots clockwise on pivot 36 in viewing FIG. 1 when the window panel is lowered by operation of the regulator assembly.

This occurs on the electrical energization of a reversible motor 72 as controlled through an interior switch 73 that controls the supply and direction of electrical energy into the motor 72 through line 74 and also the direction of current flow to control the direction of output of the motor. To this end, the motor has an output shaft connected by conventional speed reducing gearing in a gear box housing 80 operatively connected to the housing of the motor. The gear box 80 has an output spur gear 84 that drivingly meshes with the teeth 86 of the sector gear 50 so that the sector gear can be turned on pivot 36 to raise and lower the window panel.

Interposed between the gear box housing 80 and the bracket 44 is a generally triangular shaped spacer and isolator 90 mounting the motor drive to the bracket 44. This spacer and isolator is preferably molded from a suitable polyimide such as nylon or DELRIN or other suitable engineering thermoplastic material which has high strength and toughness with wear resistance that provides low frictional properties and has a quality of resilience for effective isolation purposes.

The isolator 90 has three discrete cylindrical mounting lobes 92, 94, 96 at the apices of its triangular configuration, each with an axial opening 98 therethrough to accommodate threaded fasteners 100 which are inserted through associated openings 102 in the mounting bracket 44. These fasteners tread into openings 103 in gear box housing 80. In addition to the cylindrical mounting lobes 92, 94, 96, the isolator 90 further has a centralized web 105 interconnecting the lobes which is cut out at 106 to accommodate the spur gear 84 which has shaft 107 journaled in opening 108 in bracket 44. This isolator importantly has a pair of locator pins 110 which are fitted into associated openings 111 in the bracket to precisely position the isolator in the proper position so that the threaded openings 103 in the transmission housing are in line with the openings 102 in the bracket for reception of threaded fasteners 100 and to ensure that the isolator is properly assembled and functions as intended.

Importantly, the isolator has an integral sector gear bearing 112 which projects inboard from an arch 114 that interconnects the portions of the web 105 as shown best in FIGS. 3 and 4. The inboard face of this arch is offset from the web surface of the isolator to provide a space for the arcuate and toothed portion of the sector gear 50. The sector gear bearing 112 in the arch contacts the outboard side face 116 (FIG. 2) of the sector gear to provide low friction support of the sector gear.

In addition to the support of the outboard side of the sector gear, the inboard side 118 thereof is contacted and supported by a low friction contact projection or bearing 120 of a support pad 122 of suitable low friction engineering plastics material such as DELRIN or nylon that is mounted on a bearing support tab 124 projecting inwardly into the interior triangular opening in the support bracket 44 as best shown in FIG. 3. The bearing support pad 122 has mounting posts 126 that frictionally fit into openings 128 in this support. Accordingly, and as best shown in FIG. 2, the sector gear 50 is supported by the guideway formed between the low friction bearing 112 and 120 to ensure engagement of the output gear and the sector gear teeth and to prevent any undue contact of the sector gear with the metallic components of the bracket and the housing. This further limits gear vibration and rattle while providing smooth sector gear operation. With this arrangement, the face width of the sector gear is minimized and allows the opening 51 to be maximized to effectively reduce weight of the window regulators.

In addition to reducing the width of the sector gear as provided by the improved support of the isolating mount of this invention, the cylindrical mounting lobe 92 provides a cushion limit stop for the sector gear 50. To this end, the sector gear 50 has an integral hook-like down stop 140 at one end thereof which has a contact face 142 for engaging the cushioned cylindrical lobe 92 when the gear is turned to move the window panel to the maximum down position within the well of the door. With the metallic downstop 140 contacting the cushioning plastic cylindrical lobe 92, metal-to-metal contact is eliminated and noise is resultantly minimized on downstop engagement.

The regulator assembly 17 is a cross-arm regulator which, in addition to the elongated actuator arm 34, includes a link arm 150 that has its outer end 152 secured to a forward slide 28 by pivot pin 154 and, as indicated above, the slide 28 slides within the track provided by the lower sash channel 24. The outboard link arm 150 has its inner end secured to a cylindrical connector 158 extending through central pivot opening 159 in the actuator arm 34 by axial tabs which are tabbed over into the slot 153 thereof. The inner end of an inboard link arm 160 is secured to connector 158 by axial tabs of the cylindrical connector 158 bent over to fasten within the slot 161. Accordingly, the connector provides the pivotal inner connection between the cross-arms provided by actuator arm 34 and the arms 150 and 160 interconnected as described above for a scissors-like motion when the sector gear is actuated in moving the sash panel between its lower and upper positions. The outer end of the link arm 160 is connected by a pivot pin 162 to a slide 164 that slides within an equalizer channel 166 which is secured by suitable fastener means to the inner panel 12 of the vehicle door.

When the vehicle occupant desires to actuate the window and move it from its upper position shown in FIG. 1 to the lower position within the well, the rocker-type switch shown in FIG. 1 is actuated to effect energization of the electric motor which turns to drive the output gear 84 that will turn the sector gear 50 in a clockwise direction as shown in FIG. 1. This action will continue as long as the switch is in the engaged position to move the sector gear until the cushioned engagement of the downstop lobe 92 occurs with the hooked over downstop 140. During this action, the sector gear rides between the low friction bearing 112 of the mount and the projection 120 of the bearing pad as shown in FIG. 2. This low friction bearing and guideway reduces vibration of the sector gear and allows the sector gear to be made with the cutout to reduce the weight of the regulator assembly. The position of the window can be stopped in any select position between this raised position and the down position as determined by the down stop releasing the rocker switch. When the window is moved to the down position, it will be appreciated that the arrangement of the cross-arm assembly allows the lower channel 24 to move past and beneath the equalizer channel shown in the FIG. 1.

From the downstop position, the window can be raised to any position to its maximum up position as determined by the movement of the slides in the channels so that there is complete operator control over the positioning of the window.

While the present invention has provided preferred construction for the lightweight regulator assembly utilizing a unitized motor mount and locator of an engineering plastics material, other materials can be substituted which can provide similar benefits Accordingly, the specific construction shown and described is to illustrate the invention and the limitations of this invention are to be construed by the claims which follow.

I claim:

1. A regulator assembly for moving a window panel to selected stations between first and second limits comprising cooperating gear and lever means for moving said window panel with respect to a door of a vehicle, power unit means associated with said gear and lever means for powering said window to said selected stations, support bracket means for said power unit means and said gear and lever means, the improvement comprising inner mount isolator means operatively disposed between said power unit means and said support bracket means of a plastics material effective to isolate said power unit means from said gear and lever means and from said support bracket means while providing low friction contact means for slidably supporting said gear means and to provide a cushioning stop to limit travel of said gear means in moving said window panel to at least one of said limits.

2. The regulator assembly of claim 1, the improvement further comprising bearing pad means supported by said bracket means and cooperating with said low friction contact means to form an anti-rattle guideway for said gear means movable therebetween for moving said window panel.

3. A regulator assembly for moving a window panel between a stowed position within a well of a vehicle door and an extended position in which the door and window panels effect closure of an opening in a vehicle body that accommodates the door and window, an electrically energizable motor assembly having an output gear, a pivot within said well, a sector gear meshing with said output gear and driven thereby for turning movement about said pivot, bracket means for supporting said motor assembly in a fixed position within said well and for supporting said gear for movement within said well, lever means interconnecting said sector gear with said window panel, and, isolator means of a plastics material interposed between said motor assembly and said sector gear and between said motor assembly and said bracket means to provide isolation of said motor from said gear and from said bracket means while providing low friction support of said sector gear adjacent to said output gear.

4. The regulator assembly of claim 3 wherein said sector gear has arcuately spaced arms and an arcuated toothed portion interconnecting the ends of said arms to define an opening therebetween for reducing the mass of said sector gear.

5. The regulator assembly of claim 3 wherein said isolator means is formed with a protuberance thereon for the sliding, low friction support of said gear with the engagement of one side thereof.

6. The regulator assembly of claim 3 wherein said isolator means has a low-friction protuberance thereon for engaging one side of said sector gear and where said bracket means contains a bearing pad including a protuberance of low-friction plastic material for engaging the other side of said sector gear to provide a guide for said gear in raising and lowering said window panel for reducing the vibration of said gear within said window panel.

7. The window regulator of claim 3 wherein said isolator has a stop integral therewith for engaging said gear for the cushioned limit of the movement of said gear in moving said window panel to a limit position.

8. The isolator element of claim 3 including locator pins extending from said isolator mount for engaging the support bracket to align said isolator means with said motor means for the securement of said motor means to said isolator means and to said support bracket means.

* * * * *